US006551074B2

(12) United States Patent
Kudo et al.

(10) Patent No.: US 6,551,074 B2
(45) Date of Patent: Apr. 22, 2003

(54) CENTRIFUGAL FAN WITH WATERPROOF STRUCTURE

(75) Inventors: Naruhiko Kudo, Tokyo (JP); Kesatsugu Watanabe, Tokyo (JP)

(73) Assignee: Sanyo Denki Co., Ltd., Tokyo (JP)

( * ) Notice: Subject to any disclaimer, the term of this patent is extended or adjusted under 35 U.S.C. 154(b) by 28 days.

(21) Appl. No.: 09/934,172

(22) Filed: Aug. 21, 2001

(65) Prior Publication Data

US 2002/0025261 A1 Feb. 28, 2002

(30) Foreign Application Priority Data

Aug. 22, 2000 (JP) ..... 2000-251139

(51) Int. Cl.[7] ..... F04B 35/04
(52) U.S. Cl. ..... 417/354
(58) Field of Search ..... 417/354, 353, 417/352, 321, 350, 351, 349

(56) References Cited

U.S. PATENT DOCUMENTS 5,957,769 A * 9/1999 Miyata et al. ..... 454/69
6,026,891 A * 2/2000 Fujiyoshi et al. ..... 165/104.33
6,141,217 A * 10/2000 Nakahama et al. ..... 361/694
6,166,905 A * 12/2000 Oyamada et al. ..... 361/697

FOREIGN PATENT DOCUMENTS

| | | |
|---|---|---|
| JP | 05-130755 | 5/1993 |
| JP | 05-130756 | 5/1993 |
| JP | 11-148484 | 6/1999 |
| JP | 2001-106290 | 4/2001 |

* cited by examiner

*Primary Examiner*—Teresa Walberg
*Assistant Examiner*—Vinod D. Patel
(74) *Attorney, Agent, or Firm*—Rankin, Hill, Porter & Clark LLP

(57) ABSTRACT

A centrifugal fan capable of exhibiting enhanced waterproof performance without using a resin mold while being simplified in structure. Air is sucked from one axial side of a revolving shaft of an electric motor and discharged in a radial direction of the revolving shaft. A second side wall of a casing and a wall of a blade support of an impeller have opposite surface portions arranged opposite to each other in an axial direction of the revolving shaft, respectively. The opposite surface portions are formed into a configuration which permits the opposite surface portions to cooperate with each other to provide a labyrinth structure for preventing water from intruding into a space defined between a cup-like member and the second wall from an outside in the radial direction of the revolving shaft. A first side wall and the second side wall are formed with drainage through-holes.

10 Claims, 2 Drawing Sheets

CENTRIFUGAL FAN WITH WATERPROOF STRUCTURE

BACKGROUND OF THE INVENTION

This invention relates to a centrifugal fan for sucking air from one of both sides defined along an axis of a revolving shaft of an electric motor and discharging it in a direction perpendicular to an axial direction of the revolving shaft, and more particularly a centrifugal fan exhibiting enhanced waterproof performance.

A prior art fails to develop a centrifugal fan called a sirocco fan which exhibits increased waterproof performance while being simplified in structure. For example, a centrifugal fan disclosed in Japanese Patent Application Laid-Open Publication No. 148484/1999 is so constructed that a stator which is required to exhibit waterproofness structure is covered with a resin mold.

However, techniques of covering the stator with the resin mold require much time and much cost for formation of the resin mold, to thereby fail to reduce manufacturing costs of the centrifugal fan.

SUMMARY OF THE INVENTION

The present invention has been made in view of the foregoing disadvantage of the prior art.

Accordingly, it is an object of the present invention to provide a centrifugal fan which is capable of exhibiting enhanced waterproof performance without using any resin mold while being simplified in structure.

It is another object of the present invention to provide a centrifugal fan which is capable of being simplified in structure and exhibiting waterproof performance.

It is a further object of the present invention to provide a centrifugal fan which is capable of permitting water collected in a casing to be discharged outwardly of the casing to a degree sufficient not to interfere with operation of the centrifugal fan even when accuracy at which the centrifugal fan is assembled is deteriorated.

It is still another object of the present invention to provide a centrifugal fan which is capable of exhibiting increased waterproof performance irrespective of a posture in which the centrifugal fan is mounted or operated.

In accordance with the present invention, a centrifugal fan is provided. The centrifugal fan includes an electric motor including a stator having a stator-side magnetic pole and a rotor rotated about a revolving shaft outside the stator. The rotor includes a cup-like member including a bottom wall fixed on the revolving shaft and a peripheral wall arranged so as to extend in an axial direction of the revolving shaft from an outer edge of the bottom wall, and a rotor-side magnetic pole fixed inside the peripheral wall of the cup-like member and arranged opposite to the stator-side magnetic pole of the stator. The centrifugal fan further includes an impeller including a fixed section fixed outside the cup-like member of the rotor of the electric motor, a blade support fixed on the fixed section and arranged so as to extend in a radial direction of the revolving shaft, and a plurality of blades fixed on the blade support so as to suck air on one axial side of the revolving shaft and discharge the air in the radial direction of the revolving shaft; and a casing including a first side wall provided with a suction port which is open to the one axial side of the revolving shaft, a second side wall positioned on the other axial side of the revolving shaft with respect to the first side wall and arranged so as to be spaced from the first side wall at a predetermined interval, and a peripheral wall arranged so as to connect the first side wall and second side wall to each other and form an air passage between the first side wall and the second side wall for guiding air discharged from the impeller to a discharge port which is open in a direction tangential to a direction of rotation of the impeller. The casing receives the electric motor and impeller therein. The term "one axial side" of the revolving shaft used herein is intended to mean one of both sides defined along an axis of the revolving shaft of the motor. Also, the term "the other axial side" of the revolving shaft used herein is intended to mean the other of both sides defined along the axis of the revolving shaft.

In the centrifugal fan generally constructed as described above, the electric motor is arranged in the casing so that the stator is fixed on the second side wall and the cup-like member of the rotor permits the bottom wall to face the suction port of the first side wall. The second side wall of the casing and a wall of the blade support of the impeller have opposite surface portions arranged so as to be opposite to each other in the axial direction of the revolving shaft, respectively. The opposite surface portion of the second side wall of the casing and the opposite surface portion of the wall of the blade support of the impeller each are formed into a configuration which permits the opposite surface portions to cooperate with each other to provide a labyrinth structure which prevents water from intruding into a space defined between the cup-like member and the second wall from an outside in the radial direction of the revolving shaft. The blades are mounted on a surface portion of the blade support opposite to the opposite surface portion of the blade support.

Such construction of the present invention permits the centrifugal fan to exhibit satisfactory waterproof performance while being simplified in structure without increasing an overall size thereof and using any resin mold. Also, in the present invention, as described above, the labyrinth structure is arranged at a position at which the blades are mounted, to thereby increase a length of the labyrinth structure and permit a space defined inside the labyrinth structure to be effectively utilized for receiving parts thereon.

The labyrinth structure may be constructed in any desired manner. For example, it may be constructed in such a manner that the opposite surface portion of the second side wall is formed with a plurality of cylindrical projections in a manner to project toward the one axial side of the revolving shaft and be arranged concentrically with the revolving shaft, wherein the opposite surface portion of the impeller is integrally formed thereon with a plurality of cylindrical projections in a manner to project toward the other axial side of the revolving shaft, be concentric with the revolving shaft and alternate with the cylindrical projections of the second side walls in the radial direction of the revolving shaft. Such construction permits the cylindrical projections to cooperate with each other to define a gap passage therebetween which provides the labyrinth structure. Also, it facilitates an increase in length of the gap passage. Thus, the centrifugal fan of the present invention exhibits enhanced waterproof performance while being simplified in structure.

Irrespective of arrangement of the labyrinth structure described above, the centrifugal fan has a likelihood that water is gradually collected in the casing and then intrudes from an inlet of the labyrinth structure through the labyrinth structure into the motor. In order to avoid the problem, at least one of the first and second side walls may be formed at a portion thereof positioned outwardly in the radial direction of the revolving shaft as compared with the labyrinth structure with at least one drainage through-hole for outwardly discharging water collected in the casing. The drainage through-hole may be arranged so as to extend through the side wall in the axial direction. Such arrangement of the drainage through-hole, when water collected in the casing reaches a level of the drainage through-hole, permits the water to be outwardly discharged therethrough from the casing irrespective of a posture in the centrifugal fan is operated and/or operated. This prevents water connected in the casing from intruding through the labyrinth structure into the motor. Water at a level below the drainage through-hole is still remain in the casing. However, the water does not adversely affect operation of the centrifugal fan. The drainage through-hole may be arranged at the peripheral wall. This permits water collected in the casing to be naturally discharged therethrough from the casing. However, when the drainage through-hole of the peripheral wall has a large size, air discharged from the impeller is caused to positively leak therethrough, to thereby deteriorate air feed efficiency and generate noise. Thus, a size of the drainage through-hole and the number thereof are preferably limited to the minimum.

When it is possible to previously know a posture in which the centrifugal fan is operated, a position of the drainage through-hole may be determined depending on the posture. However, in the case of a general-purpose centrifugal fan, a posture in which it is mounted or operated is varied depending on a user. Thus, it is preferable that at least one of the first side wall and second side wall is formed with a plurality of drainage through-holes in a manner to be spaced from each other at intervals in a peripheral direction of the revolving shaft. Such arrangement of the through-holes permits water collected in the casing to be outwardly discharged from the drainage through-holes of the side wall without substantially considering a posture of operation of the centrifugal fan, to thereby enhance general-purpose properties of the centrifugal fan. In particular, in this instance, arrangement of one or more such drainage through-holes at both first side wall and second side wall substantially prevents intrusion of water into the electric motor irrespective of a posture of mounting and/or operation of the centrifugal fan. In this instance, the first side wall and second side wall each may be formed with at least one such drainage through-hole. This prevents intrusion of water into the motor irrespective of a posture of mounting and/or operation of the centrifugal fan.

For example, when the drainage through-hole is formed at the side wall of the casing, at least one of the first side wall and second side wall is formed with a plurality of drainage through-holes at a portion thereof positioned in an angular range except a predetermined angular range defined about the revolving shaft and including the discharge port when the first side wall is viewed from the one axial side of the revolving shaft. In this instance, the drainage through-holes may be arranged at portions of the first side wall and second side wall positioned in the predetermined angular range including the discharge port. However, when the centrifugal fan is operated in a posture which may possibly cause water to be collected in the casing under such conditions, water collected in the casing to a degree is permitted to be discharged from the discharge port, so that it is not required to form the drainage through-holes in the angular range. Thus, at least one drainage through-hole may be formed at a position which permits water collected in the casing to be discharged through the drainage through-hole when the centrifugal fan is operated or mounted in a posture which keeps water entering the casing through the suction port from being discharged through the discharge port. Thus, at least one of the first side wall, second side wall and peripheral wall may be formed with at least one drainage through-hole for discharging water in the casing when the centrifugal fan is operated or mounted in a posture which keeps water entering the casing through the suction port from being discharged through the discharge port.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
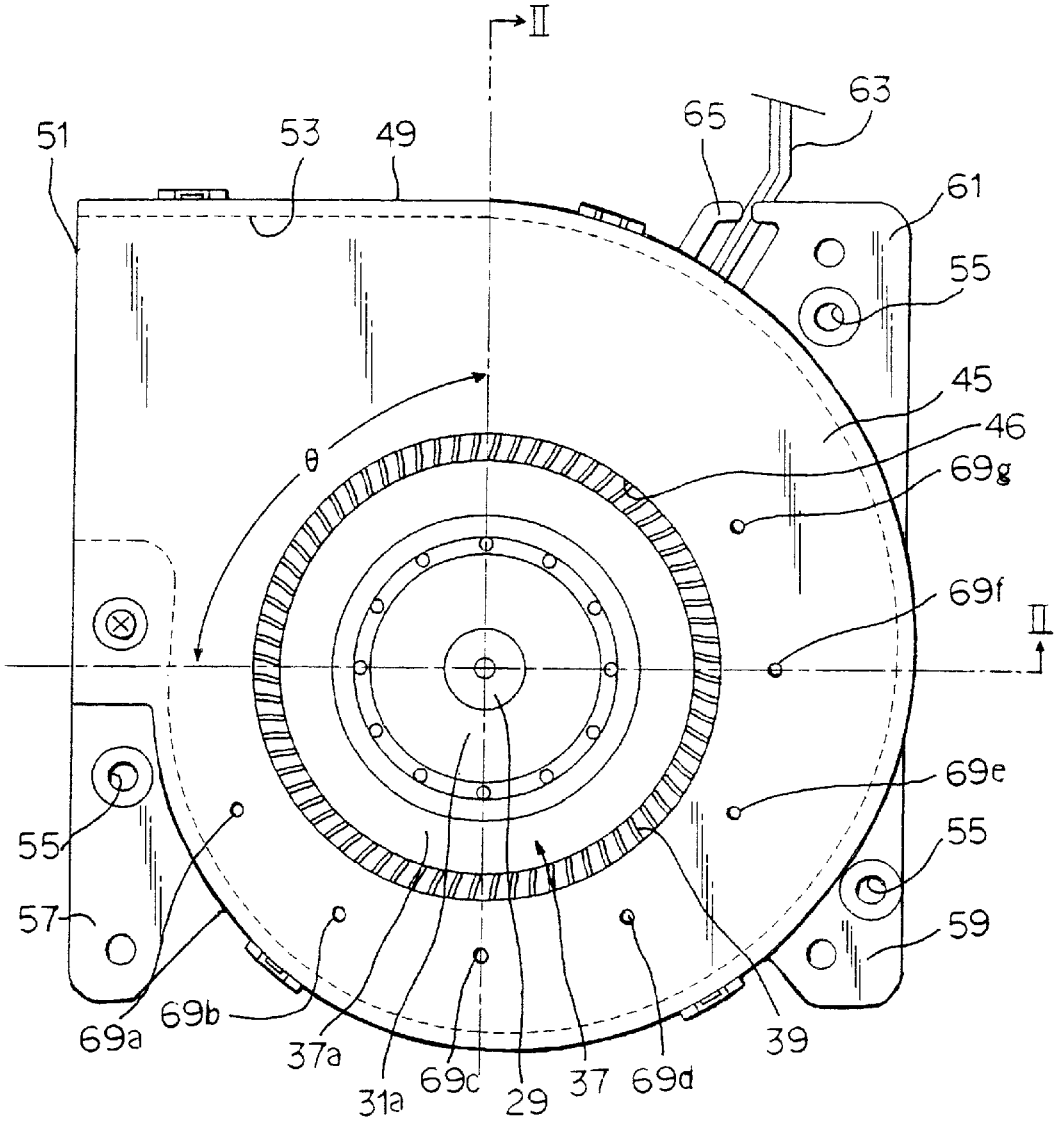
FIG. 1 is a front elevation view showing an embodiment of a centrifugal fan according to the present invention.

Now, a centrifugal fan according to the present invention will be described with reference to FIGS. 1 and 2 which show an embodiment of a centrifugal fan according to the present invention.

A centrifugal fan of the illustrated embodiment generally includes an electric motor 1, an impeller 3 rotated by the electric motor 1, a casing 5 in which the electric motor 1 and impeller 3 are received. In the illustrated embodiment, the centrifugal fan is in the form of a sirocco fan. The electric motor 1 is constituted by a stator 7 and a rotor 11 rotated about a revolving shaft 9 outside the stator 7. The stator 7 is fitted on a bearing holder 17 which is made of metal and in which two ball bearings 13 and 15 for rotatably supporting the revolving shaft 9 are fittedly held. The stator 7 is constituted by a stator core 19 arranged outside the bearing holder 17, an insulator 21 which is fitted in the stator core 19 and made of insulating resin, and stator windings 23 wounded on a plurality of salient-pole sections of the stator core 19 through the insulator 21. The stator windings 23 each are electrically connected to a circuit pattern (not shown) formed on a circuit board 27 through a connecting conductor 25. The circuit board 27 is mounted thereon with a drive circuit for feeding an excitation current to the stator windings 23.

The rotor 11 includes a cylindrical boss 29 made of an insulating material and fixed on the revolving shaft 9, a cup-like member 31 made of magnetically conductive material and fixed on the revolving shaft 9 through the boss 29, and a rotor-side magnetic pole constituted by a plurality of permanent magnets fixed on the cup-like member 31. The cup-like member 31 includes a bottom wall 31*a* formed at a central portion thereof with a through-hole via which the boss 29 extends and a cylindrical peripheral wall 31*b* arranged so as to extend from an outer edge portion of the bottom wall 31*a* in an axial direction of the revolving shaft 9. The plural permanent magnets constituting the rotor-side magnetic pole 33 are joined to an inner peripheral surface of the peripheral wall 31*b* of the cup-like member 31, to thereby be opposite to a magnetic pole surface of the stator core 19 constituting a stator-side magnetic pole of the stator 7.

The impeller 3 includes a fixed section 35 fixed outside the cup-like member 31 of the rotor 11 of the electric motor 1, a blade support 37 fixed on the fixed section 35 and arranged so as to extend in a radial direction of the revolving shaft 9, a plurality of blades 39 fixed on the blade support 37 so as to suck air from one of both sides defined along an axis of the revolving shaft 9 of the motor 1 or one axial side of the revolving shaft 9 (or from a right-hand side in FIG. 2 or a forward side therein) and discharge the air in the radial direction of the revolving shaft 9. The impeller 3 is integrally formed of synthetic resin. The fixed section 35 of the impeller 3 is formed into a flanged cylindrical configuration and fitted on both the peripheral wall 31*b* of the cup-like member 31 and an annular step 31*c* formed between the peripheral wall 31*b* and the bottom wall 31*a*. Also, the fixed section 35 of the impeller 3 is joined to the cup-like member 31. The blade support 37 includes a frust-conical cylindrical portion 37*a* having one end formed in a manner to be integral with the cup-like member 35 and gradually increased in diameter toward the other of both sides defined along the axis of the revolving shaft 9 or the other axial side of the revolving shaft 9. Also, the blade member 35 includes an annual blade mount portion 37*b* formed integrally with the other end of the frust-conical cylindrical portion 37, arranged so as to extend in the radial direction of the revolving shaft 9 and mounted thereon with the plural blades 39. The blade mounting portion 37*b* is integrally formed on a wall thereof positioned on the other axial side of the revolving shaft 9 or opposite to a second side wall of the casing 5 described below with three cylindrical projections 41*a* to 41*c*. The cylindrical projections 41*a* to 41*c* are arranged so as to extend toward the other axial side of the revolving shaft 9, be concentric with the revolving shaft 9 and be spaced from each other in the radial direction.

The casing 5 in which the electric motor 1 and impeller 3 are received is constructed into a two-part structure. More particularly, it is constituted by a first casing half 45 and a second casing half 47. The first casing half 45 is constituted by a first side wall 45*a* provided with a suction port 46 which is open to the one axial side (or forward side) of the revolving shaft 9 and a first peripheral wall half 45*b* arranged so as to extend toward the other axial side (or backward side) of the revolving shaft 9 from a peripheral portion of the first side wall 45*a*. The second casing half 47 is constituted by a second side wall 47*a* positioned on the other axial side of the revolving shaft 9 with respect to the first side wall 45*a* and arranged so as to be spaced from the first side wall 45*a* at a predetermined interval. The second casing half 47 is also constituted by a second peripheral wall half 47*b* arranged so as to extend toward the one axial side of the revolving shaft 9 from a peripheral portion of the second side wall 47*a*. The first peripheral wall half 45*b* and second peripheral wall half 47*b* each are formed at an end thereof with a step continuously extending along a peripheral edge thereof. These steps are mated with each other, so that a peripheral wall 49 may be provided by connecting the first side wall 45 and second side wall 47 to each other by the first peripheral wall half 45*b* and second peripheral wall half 47*b*. The peripheral wall 49 connects the first side wall 45*a* and second side wall 47*a* to each other, to thereby form an air passage 53 for guiding air discharged from the impeller 3 to a discharge port 51 which is open in a tangential direction with respect to a direction of rotation of the impeller 3. As shown in FIG. 1, the second casing half 47 is integrally provided with flanges 57 to 61 each formed with a through-hole 55 via which a screw for mounting the fan is inserted. The flange 61 is formed with a lead wire catching portion 65. The lead wire catching portion 65 catches a lead wire 63 for electric supply extending from the motor 1.

The second side wall 47*a* of the second casing half 47 is integrally formed with three cylindrical projections 48*a* to 48*c* projecting toward the one axial side of the revolving shaft 9 and arranged so as to be concentric with the revolving shaft 9. The above-described cylindrical projections 41*a* to 41*c* formed on the wall of the impeller 3 opposite to the second side wall 47*a* and the cylindrical projections 48*a* to 48*c* formed on the second side wall 47*a* are arranged in the radial direction in a manner to alternate with each other and be spaced from each other at intervals. Such arrangement of the projections 41*a* to 41*c* and 48*a* to 48*c* permits gaps g to be defined therebetween in a zigzag manner. The thus-formed gaps g cooperate with each other to provide a labyrinth structure 67 which functions to effectively prevent intrusion of water into a space formed between the cup-like member 31 and the second side wall 47*a* from an outside in the radial direction of the revolving shaft 9.

In the illustrated embodiment, the first side wall 45*a* and second side wall 47*a* are formed with a plurality of drainage through-holes 69*a* to 69*g* and drainage through-holes 71, respectively, in a manner to extend through the side walls 45*a* and 47*a* in the axial direction at a position defined outwardly in the radial direction of the revolving shaft 9 as compared with the labyrinth structure 67. The drainage through-holes thus-formed function to permit water entering the casing to be discharged from the casing therethrough. Likewise, the second side wall 47*a* is formed with drainage through holes 71 corresponding in number to the drainage through-holes 69*a* to 69*g*. The drainage through-holes 69*a* to 69*g* and 71 are formed so as to extend through the first and second side walls 45*a* and 47*a* while being spaced from each other at predetermined intervals in the peripheral direction of the revolving shaft 9. More specifically, the drainage through-holes are arranged at angular intervals of about 15 degrees in the peripheral direction of the revolving shaft.

Figure 2:
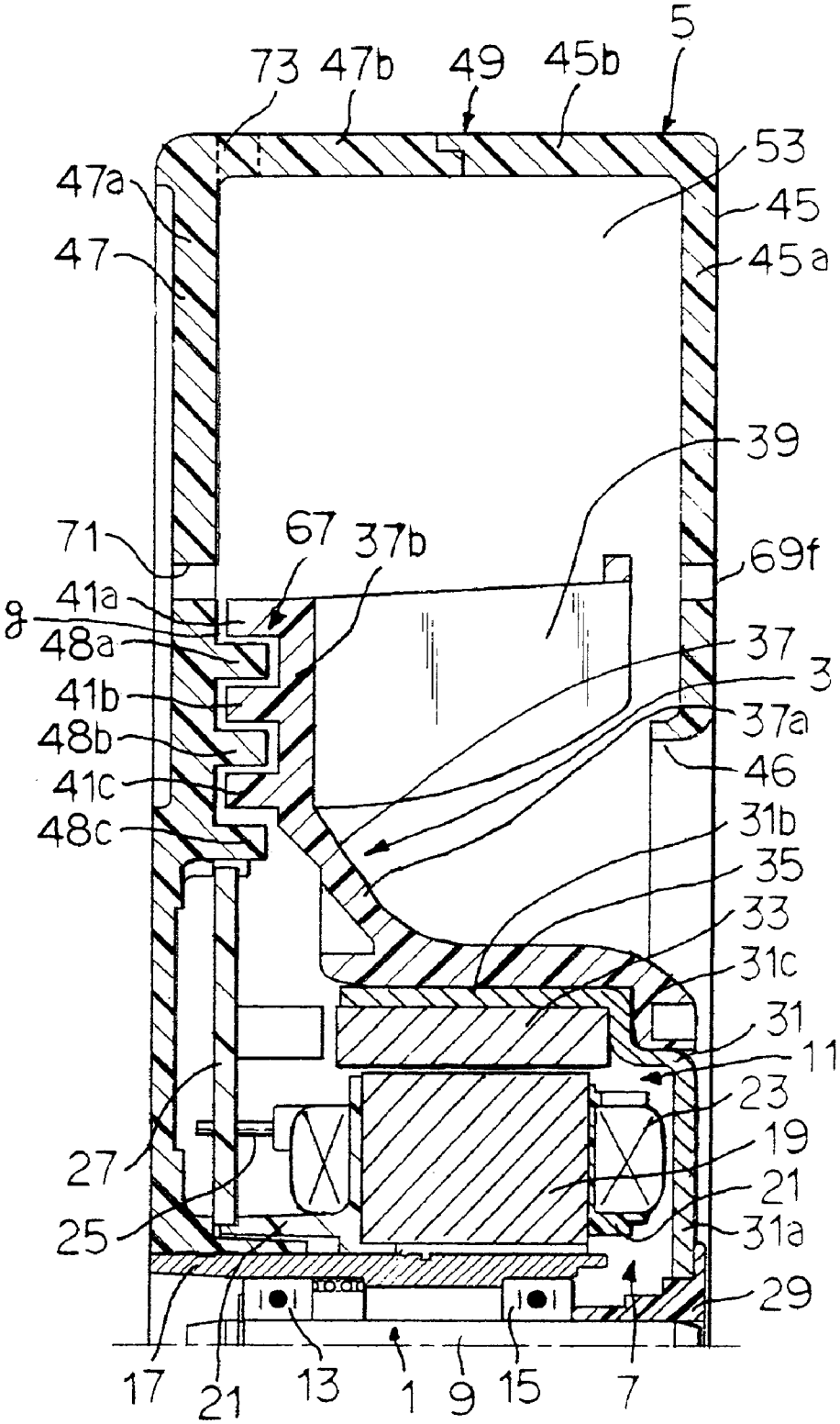
FIG. 2 is a sectional view taken along line II—II of FIG. 1

Supposing that a perpendicular direction in FIG. 1 is defined to be a vertical direction and a direction perpendicular to the sheet of FIG. 1 is defined to be a horizontal direction, arrangement of the centrifugal fan shown in FIG. 1 permits water entering the casing 5 through the suction port 46 to be collected in the air passage 53 formed in the casing 5. When water collected in the air passage 53 reaches a level equal to the drainage through-hole 69*c* in FIG. 1, it is outwardly discharged through the drainage through-hole 69*c* from the casing 5. This, even when water is collected in the casing 5, prevents it from reaching a level at which the electric motor 1 is arranged. Also, the centrifugal fan of the illustrated embodiment includes the labyrinth structure 67, to thereby effectively prevent water carried on air flowing in the air passage 53 from intruding through a gap defined between the impeller 3 and the second side wall 47*a* of the casing 5 into the space in which the electric motor 1 is arranged.

In the illustrated embodiment, when the first side wall 45*a* is viewed from the one axial side of the revolving shaft 9 or from a side of the suction port 46, the drainage through-holes 69*a* to 69*g* and 71 are arranged at portions of the first side wall 45*a* and second side wall 47*a* positioned in an angular range (360°−θ) except a predetermined angular range θ including the discharge port 51 about the revolving shaft 9, respectively. In the illustrated embodiment, the angular range (360°−θ) is set to be an angular range of 90 degrees in terms of a mechanical angle. The drainage through-holes may be arranged at portions of the first side wall 45*a* and second side wall 47*a* positioned in the predetermined angular range θ including discharge port 51. However, when the centrifugal fan is operated in a posture which may possibly cause water to be collected in the casing under such conditions, water collected in the casing to a degree is permitted to be discharged from the discharge port 51, so that it is not required to form the drainage through-holes in the angular range θ.

From such a viewpoint, it will be understood that it is required to arrange one or more such drainage through-holes at a position which permits water collected in the casing 5 to be outwardly discharged therethrough when the centrifugal fan is operated in a posture which keeps water collected in the casing from being discharged through the discharge port 51. Thus, one or more such drainage through-holes are required to be formed at at least one of the first side wall 45*a*, second side wall 47*a* and peripheral wall 49 of the casing 5 in order to ensure that water collected in the casing may be outwardly discharged therethrough when the centrifugal fan is operated in a posture which permits water collected in the casing 5 to be discharged from or drawn out of the discharge port 51. When one or more such drainage through-holes are arranged at the peripheral wall 49 of the casing 5, drainage through-holes 73 are preferably arranged in proximity to the second side wall 47*a* as much as possible, as indicated at broken lines in FIG. 2. This is for the reason that arrangement of the drainage through-holes 73 at the peripheral wall 49 of the casing 5 while being in close proximity to a center of the peripheral wall 49 may lead to a likelihood of causing air discharged in the radial direction of the revolving shaft 9 from the impeller 9 to leak in a relatively large amount from the drainage through-hole of the peripheral wall 49.

When a posture or condition in which the centrifugal fan is operated is previously known, the drainage through-holes may be positioned depending on the posture. However, in the case of a general-purpose centrifugal fan, a posture in which it is operated is varied depending on a user. Thus, it is preferable that at least one of the first side wall 45*a* and second side wall 47*a* is formed with the plural drainage through-holes 69*a* to 69*g* and 71 in a manner to be spaced from each other at intervals in the peripheral direction of the revolving shaft 9. Such arrangement of the through-holes permits water collected in the casing 5 to be outwardly discharged from the drainage through-holes of the side wall without substantially considering a posture of operation of the centrifugal fan, to thereby enhance general-purpose properties of the centrifugal fan. In particular, in this instance, arrangement of one or more such drainage through-holes at both first side wall 45*a* and second side wall 47*a* substantially prevents intrusion of water into the electric motor 1 irrespective of a posture of mounting and/or operation of the centrifugal fan.

The centrifugal fan of the illustrated embodiment employs the labyrinth structure, as well as the drainage through-holes. However, the centrifugal fan of the present invention merely requires arrangement of the labyrinth structure. Also, in the illustrated embodiment, the plural drainage through-holes are arranged at both first side wall 45*a* and second side wall 47*a* of the casing 5. Nevertheless, in the present invention, it is merely required to form at least one such drainage through-hole via at least one of the first and second side walls 45*a* and 47*a*. Alternatively, the drainage through-hole may be provided at only the peripheral wall 49 of the casing 5.

As can be seen from the foregoing, the present invention permits the centrifugal fan to exhibit satisfactory waterproof performance while being simplified in structure without increasing an overall size thereof and using any resin mold. Also, in the present invention, the labyrinth structure is arranged at a position at which the blades are mounted, to thereby increase a length of the labyrinth structure and permit a space defined inside the labyrinth structure to be effectively utilized for receiving parts thereon.

What is claimed is:

1. A centrifugal fan comprising:

an electric motor including a stator having a stator-side magnetic pole and a rotor rotated about a revolving shaft outside said stator;

said rotor including a cup-like member including a bottom wall fixed on said revolving shaft and a peripheral wall arranged so as to extend in an axial direction of said revolving shaft from an outer edge of said bottom wall, and a rotor-side magnetic pole fixed inside said peripheral wall of said cup-like member and arranged opposite to said stator-side magnetic pole of the said stator;

an impeller including a fixed section fixed outside said cup-like member of said rotor of said electric motor, a blade support fixed on said fixed section and arranged so as to extend in a radial direction of said revolving shaft, and a plurality of blades fixed on said blade support so as to suck in air on one axial side of said revolving shaft and discharge the air in the radial direction of said revolving shaft;

a casing including a first side wall provided with a suction port which is open to said one axial side of said revolving shaft, a second side wall positioned on the other axial side of said revolving shaft with respect to said first side wall and arranged so as to be spaced from said first side wall at a predetermined interval, and a peripheral wall arranged so as to connect said first side wall and second side wall to each other and form an air passage between said first side wall and said second side wall for guiding air discharged from said impeller to a discharge port which is open in a direction tangential to a direction of rotation of said impeller;

said casing receiving said electric motor and impeller therein;

said electric motor being arranged in said casing so that said stator is fixed on said second side wall and said cup-like member of said rotor permits said bottom wall to face said suction port of said first side wall;

said second side wall of said casing and a wall of said blade support of said impeller having opposite surface portions arranged so as to be opposite to each other in said axial direction of said revolving shaft, respectively;

said opposite surface portion of said second side wall of said casing and said opposite surface portion of said wall of said blade support of said impeller each being formed into a configuration which permits said opposite surface portions to cooperate with each other to provide a labyrinth structure which prevents water from intruding into a space defined between said cup-like member and said second wall from an outside in the radial direction of said revolving shaft;

said blades being mounted on a surface portion of said blade support opposite to said opposite surface portion of said blade support.

2. A centrifugal fan as defined in claim 1, wherein said opposite surface portion of said second side wall is formed with a plurality of cylindrical projections in a manner to project toward said one axial side of said revolving shaft and be arranged concentrically with said revolving shaft; and said opposite surface portion of said impeller is integrally formed thereon with a plurality of cylindrical projections in a manner to project toward the other axial side of said revolving shaft, be concentric with said revolving shaft and alternate with said cylindrical projections of said second side walls in said radial direction of said revolving shaft;

said cylindrical projections cooperating with each other to define gaps therebetween which provide a labyrinth structure.

3. A centrifugal fan as defined in claim 2, wherein said at least one drainage through-hole is formed at a position which permits water collected in said casing to be discharged through said drainage through-hole when said centrifugal fan is operated in a posture which keeps water entering said casing through said suction port from being discharged through said discharge port.

4. A centrifugal fan as defined in claim 1, wherein at least one of said first and second side walls is formed at a portion thereof positioned outwardly in said radial direction as compared with said labyrinth structure with at least one drainage through-hole for outwardly discharging water collected in said casing;

said drainage through-hole being arranged so as to extend through said side wall in said axial direction.

5. A centrifugal fan as defined in claim 4, wherein at least one of said first and second side walls is formed with a plurality of said drainage through-holes in a manner to be spaced from each other at predetermined intervals in a peripheral direction of said revolving shaft.

6. A centrifugal fan as defined in claim 5, wherein at least one of said first side wall and second side wall is formed with a plurality of said drainage through-holes at a portion thereof positioned in an angular range except a predetermined angular range defined about said revolving shaft and including said discharge port when said first side wall is viewed from said one axial side of said revolving shaft.

7. A centrifugal fan as defined in claim 4, wherein said first side wall and second side wall each are formed with said at least one drainage through-hole.

8. A centrifugal fan as defined in claim 4, wherein said at least one drainage through-hole is formed at a position which permits water collected in said casing to be discharged through said drainage through-hole when said centrifugal fan is operated in a posture which keeps water entering said casing through said suction port from being discharged through said discharge port.

9. A centrifugal fan as defined in claim 1, wherein said at least one drainage through-hole is formed at a position which permits water collected in said casing to be discharged through said drainage through-hole when said centrifugal fan is operated in a posture which keeps water entering said casing through said suction port from being discharged through said discharge port.

10. A centrifugal fan as defined in claim 1, wherein at least one of said first side wall, second side wall and peripheral wall is formed with at least one drainage through-hole for discharging water in said casing when said centrifugal fan is operated at a posture which keeps water entering said casing through said suction port from being discharged through said discharge port.

* * * * *